US005094035A

United States Patent [19]

Oike et al.

[11] Patent Number: 5,094,035

[45] Date of Patent: Mar. 10, 1992

[54] AUTOMATIC LAPPING DEVICE FOR MAGNETIC DRUM OF MAGNETOGRAPHIC PRINTING MACHINE

[75] Inventors: Hideo Oike, Hachioji; Yukiaki Isobe, Machida, both of Japan

[73] Assignee: Iwatsu Electric Co., Ltd., Tokyo, Japan

[21] Appl. No.: 518,213

[22] Filed: May 3, 1990

[30] Foreign Application Priority Data

May 11, 1989 [JP] Japan ..... 1-53375

[51] Int. Cl.[5] ..... B24B 21/00

[52] U.S. Cl. ..... 51/140; 51/145 R

[58] Field of Search ..... 51/149, 135, 141, 147, 51/148, 142, 137, 145 X

[56] References Cited

U.S. PATENT DOCUMENTS 3,095,674 7/1963 Lee ..... 51/142
3,665,650 5/1972 Pryzgocki ..... 51/142
3,760,537 9/1973 Bovati ..... 51/145 R

*Primary Examiner*—Bruce M. Kisliuk
*Assistant Examiner*—Lawrence Cruz
*Attorney, Agent, or Firm*—Paul & Paul

[57] ABSTRACT

An automatic lapping device for polishing a surface of a magnetic drum of a magnetographic printing machine. The automatic lapping device comprises a lapping unit mounted on a carriage of a magnetic recording head, for polishing the magnetic drum surface, and the lapping unit includes a lapping sheet retainer movable between a stand-by position and an operating position, and thus, in the operating position, the lapping sheet held by the retainer is pressed against the drum surface with a constant pressure. To polish the drum surface, the magnetic drum is rotated by a recording motor and the magnetic drum surface is vertically scanned by the lapping unit while the retainer is in the operating position, utilizing a vertical scanning motor of the carriage, and after completing the vertical scanning, the retainer is moved to the stand-by position away from the drum surface. The lapping sheet is renewed automatically in response to the movement of the retainer from the operating position to the stand-by position. Also, a lapping control unit is provided for executing these operation steps automatically in accordance with a predetermined procedure.

7 Claims, 6 Drawing Sheets

KEY SWITCH ON
100
RECORDING MOTOR ON
101
PREDETERMINED SPEED ?
102
NO
YES
ACCESS SOLENOID ON
103
VERTICAL SCANNING MOTOR ON
(FORWARD)
104
ACCESS SOLENOID ON
203
VERTICAL SCANNING MOTOR ON
(REVERSE)
204
RECORDING MOTOR OFF
300
VERTICAL SCANNING MOTOR ON
(REVERSE)
310

AUTOMATIC LAPPING DEVICE FOR MAGNETIC DRUM OF MAGNETOGRAPHIC PRINTING MACHINE

BACKGROUND OF THE INVENTION

1. Field of the Invention

The present invention relates to a lapping device for polishing a surface of a magnetic drum used in a magnetographic printing machine. In particular, it relates to an automatic lapping device used for obtaining a required surface finish of the magnetic drum during the production of the magnetographic printing machine, and for removing a layer of deposited matter such as toner or paper dust formed on the surface thereof after the magnetographic printing machine has been operated for a certain period.

2. Description of the Related Art

In the printing process of the magnetographic printing machine, a magnetic latent image formed on the surface of the magnetic drum is converted to a visual image by adhering toner particles to the surface of the magnetic drum, and the toner particles on the drum surface are then transferred to and fixed on a surface of a paper, to provide a hard copy of the image.

Consequently, after a certain period of operation, a thin film-like layer of deposited plastic component contained in the toner particles is formed on the magnetic drum surface. The formation of this thin film is called "filming". Also, a layer is formed on the drum surface by the depositing thereon of foreign matter such as paper dust.

To form the latent image on the magnetic drum, the drum surface is scanned by a magnetic recording head, and during this scanning, a carriage supporting the magnetic recording head is moved in parallel to the axis of rotation of the magnetic drum by a vertical scanning motor. (This operation is called "vertical scanning".) During this vertical scanning, the magnetic drum is rotated at a high speed by a recording motor, and the magnetic recording head is controlled in accordance with the phase angle of the drum rotation and the position of the magnetic recording head during the vertical scanning, to magnetize a required area of the drum surface.

The magnetic recording head is supported at a predetermined distance from the drum surface during the vertical scanning by an air bearing formed by an air stream caused by the rotation of the rotating drum. If filming occurs on the drum surface, the distance between the magnetic recording head and the drum surface to be magnetized becomes larger than the predetermined distance, and therefore, it becomes difficult to obtain a clear hard copy because the magnetizing intensity of the drum surface is lowered due to this larger distance.

Moreover, if the magnetic recording head comes into contact with the deposits of foreign matter on the drum surface, during the vertical scanning, the magnetic recording head rebounds away from the drum surface, and accordingly, the drum surface is not magnetized in the area at which this rebounding occurs and blank lines appear in the printed images.

To prevent an occurrence of the above defects, the drum surface must be periodically polished to remove foreign matter therefrom. Usually, this polishing of the drum surface (hereinafter called "lapping") is carried out by pressing a lapping sheet by hand against the surface of the drum while the drum is rotated at a high speed. The lapping sheet is usually a plastic film having an abrasive material such as aluminum oxide coated on the surface thereof.

Nevertheless, a problem arises with regard to this polishing or lapping by hand, in that it is difficult to press the lapping sheet against the drum surface with a constant force, and thus it is very difficult for even a skilled person to obtain a uniform lapping of the entire surface of the drum. Further, in this lapping operation since the lapping sheet must be pressed by hand against a drum surface rotating at a high speed, this is not desirable from the view point of safety.

An object of the present invention is to solve the above-described problems and to provide an automatic lapping device by which the surface of the drum is automatically lapped in a safer manner, and a uniform lapping of the drum surface is ensured.

SUMMARY OF THE INVENTION

According to the present invention, there is provided an automatic lapping device for polishing the magnetic drum surface of the magnetographic printing machine with a lapping sheet, comprising:

a lapping unit including a retainer means for retaining the lapping sheet and movable between a stand-by position at which the lapping sheet is held away from the magnetic drum surface and an operating position at which the lapping sheet is pressed against the drum surface with a predetermined force; an access means for moving the retainer means between the stand-by position and the operating position; a lapping sheet renewal means for shifting the lapping sheet to bring a fresh portion thereof into contact with the magnetic drum surface in response to the movement of the retainer means between the operating position and the stand-by position; a vertical scanning means for moving the lapping unit in parallel to the axis of rotation of the magnetic drum; a drive means for rotating the magnetic drum; and a lapping control means for controlling the operation of the access means, the vertical scanning means, and the drive means in accordance with a predetermined procedure, to thereby polish the drum surface.

During the lapping operation, the retainer means is moved to the operating position by the access means and presses the lapping sheet against the surface of the drum, which is rotated at a high speed by the drive means. Then the vertical scanning means moves the retainer means in parallel to the axis of rotation of the drum, whereby the lapping sheet is moved along the drum surface while in contact with the drum surface, with a constant pressure, and thus uniformly polishes the entire drum surface.

Upon completion of each vertical scanning of the retainer means, the renewal means shifts the surface of the lapping sheet in preparation for the next vertical scanning. The lapping operation is performed automatically under the control of the lapping control means.

BRIEF DESCRIPTION OF THE DRAWINGS

The present invention will become more apparent from the following description of the preferred embodiment with reference to the accompanying drawings, in which.

DESCRIPTION OF THE PREFERRED EMBODIMENT

Figure 1:
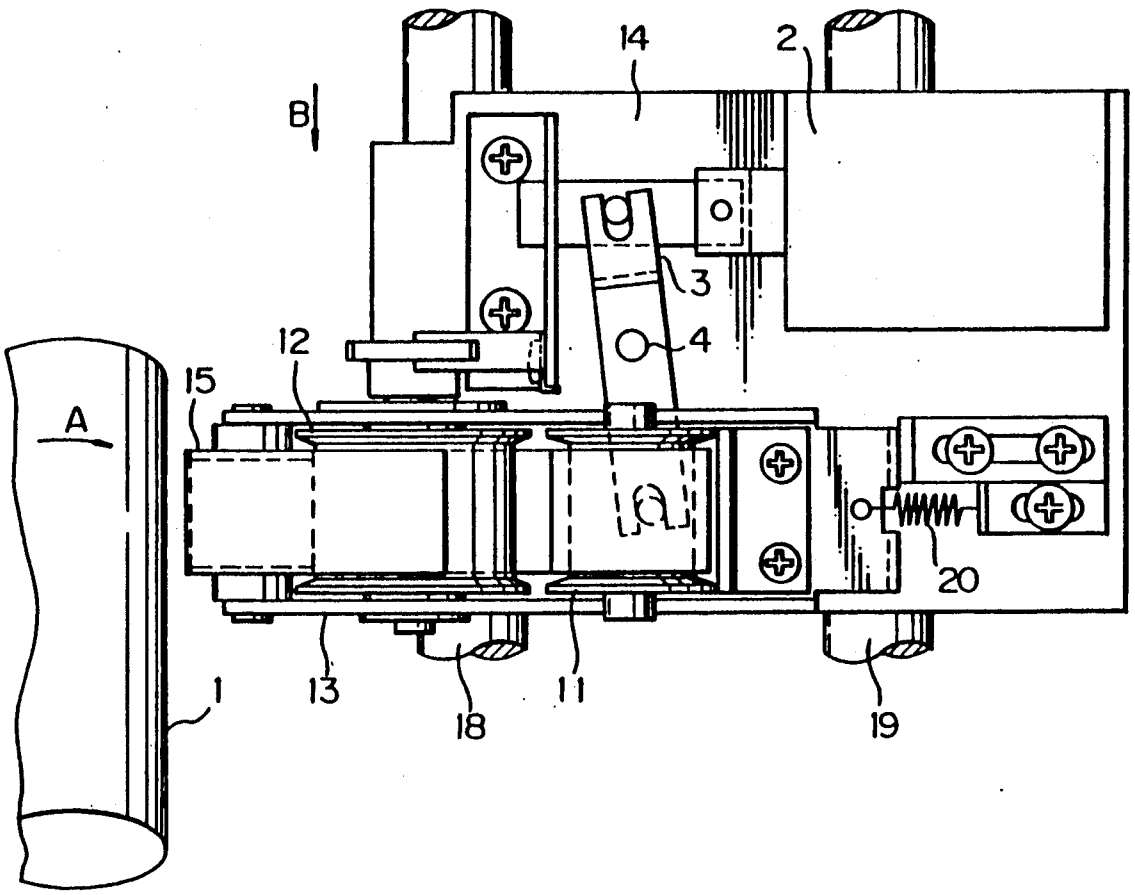
FIG. 1 is a plan view of a lapping unit according to the present invention.

FIGS. 1 and 2 show a lapping unit, which is a part of the automatic lapping device according to the present invention.

As shown in FIGS. 1 and 2, a lapping unit 10 comprises a supply reel 11 for supplying a lapping sheet 15, a take up reel 12, a pressure roller 16, and a retainer 13 for carrying the reels 11 and 12 and the pressure roller 16. In this embodiment the lapping sheet is supplied in rolls, and these rolls are commercially available (e.g., under the trade name "SUMITOMO-3M IMPERIAL LAPPING FILM ROLL 10061"produced by SUMITOMO-3M CO. LTD. Japan.)

Figure 5:
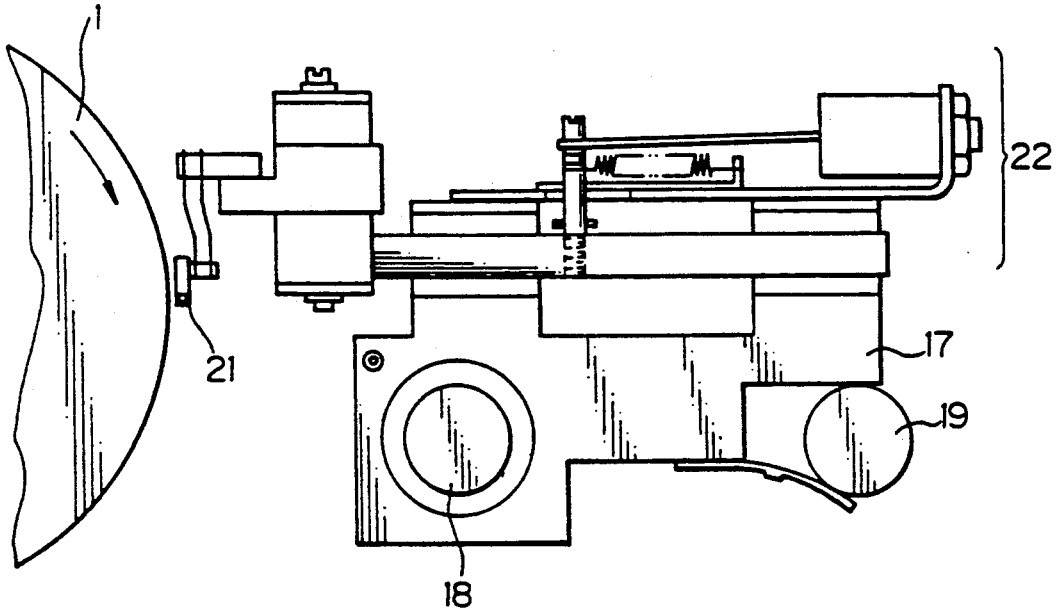

As shown in FIG. 1, an access solenoid 2 is provided to move the retainer 13 vertically to the axis of the magnetic drum 1 through an arm 3 and a pin 4 against the force of a return spring 20. The retainer 13, the arm 3, and the pin 4 are mounted on a base plate 14, which is a part of the lapping unit 10. The base plate 14 can be mounted on a carriage 17 of a magnetographic printing machine in place of a head supporting unit 22 which, as shown in FIG. 5, is installed on the carriage 17 to carry a magnetic recording head 21 for a normal operation of the magnetographic printing machine.

The magnetographic printing machine is equipped with a pulse motor type vertical scanning motor 160 (FIG. 3) by which the carriage 17 is moved along guides 18 and 19 during the vertical scanning in a normal mode.

Figure 3:
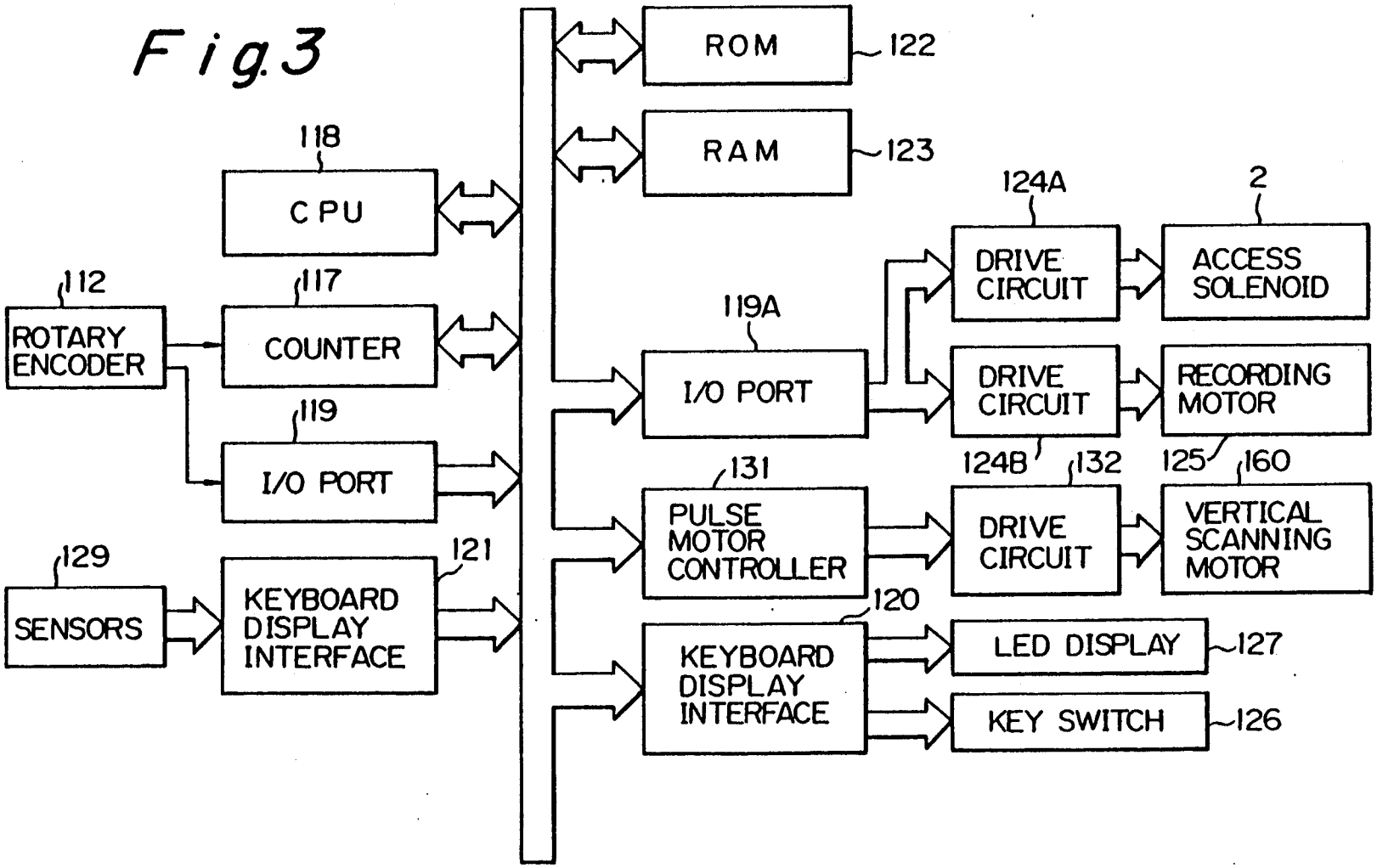
FIG. 3 is a block diagram of a lapping control unit of the FIG. 1.

In this embodiment, the magnetic printing machine is provided with a control unit 100 for automatic lapping operation (hereinafter called "lapping control unit") in addition to a conventional control unit for a normal operation, as shown in FIG. 3.

The lapping control unit 100 comprises a microprocessor (CPU) 118, a read only memory (ROM) 122, and a random access memory (RAM) 123. The CPU 118 operates the control circuit 100 in accordance with a program stored in the ROM 122, and the RAM 123 provides a work area for the CPU 118.

A rotary encoder 112 is connected to a shaft (not shown) of the magnetic drum 1 for sensing the rotation thereof, and clock pulses generated by the rotary encoder 112 are converted to a phase signal by a counter 117 and fed to the CPU 118. Further, index pulses are fed to CPU 118 through an input-output (I/O) port 119, and the clock pulses and the index pulses are used for calculating the rotating speed of the magnetic drum 1. Sensors 129 located at both ends of the guides 18, 19, are used to detect the carriage 17 when the vertical scanning is completed. The sensors 129 transmit signals indicating the completion of the vertical scanning to the CPU 118, via a keyboard display interface 121. A key switch 126 is arranged on an operation control panel (not shown) of the magnetographic printing machine, and when operated, transmits a signal to the CPU 118, via another keyboard display interface 120, to initiate the lapping operation. Also, an operating condition signal is transmitted from the CPU 118 to an LED display 127 on the operation control panel, through the interface 120, to indicate a start and stop of the lapping operation.

The CPU 118 actuates electrical units such as the access solenoid 2 of the lapping unit 10 and a recording motor 125 of the magnetic drum 1, through an I/O port 119A and drive circuits 124A and 124B.

The CPU 118 also controls the movement of the carriage 17 during the vertical scanning by operating the vertical scanning motor 160 through a pulse motor controller 131 and a drive circuit 132.

The operation of the automatic lapping device is now explained.

Prior to the lapping operation, the head support unit 22 is removed from the carriage 17 and the lapping unit 10 is installed thereon. Then, when the key switch 126 is switched ON, the CPU 118 of the lapping control unit 100 starts the recording motor 125 of the magnetic drum 1 to rotate it in the direction of an arrow A in FIG. 1. The CPU 118 calculates the speed of the drum 1 from the pulses output by the rotary encoder 112, and when the speed of the drum reaches the predetermined speed, the CPU 118 maintains the speed of the drum at that value and energizes the access solenoid 2.

Figure 2A:
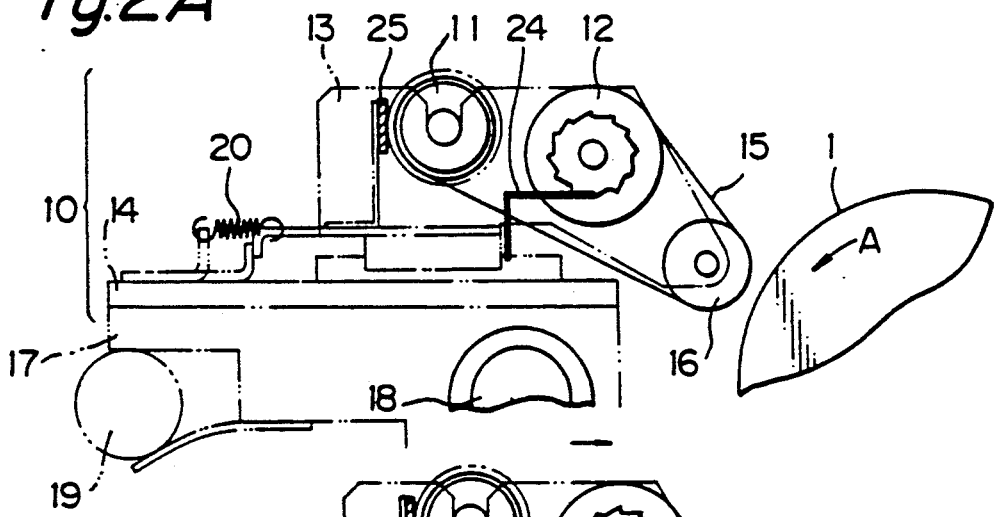
FIG. 2A to FIG. 2D are side elevational view of the lapping unit in FIG. 1, showing steps of the lapping operation.
Figure 2B:
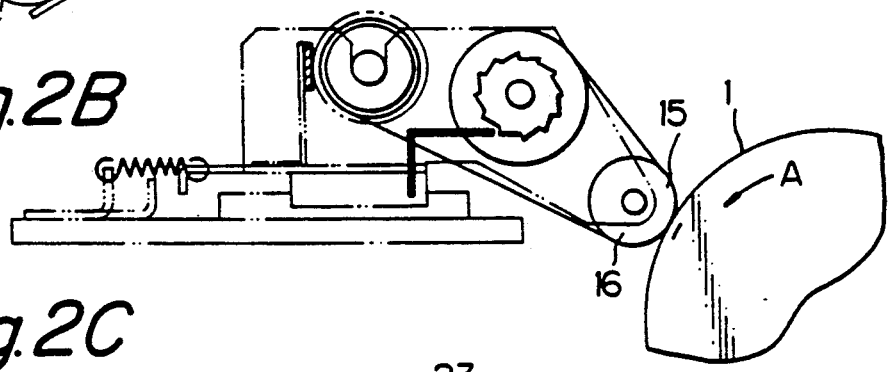
Figure 2C:
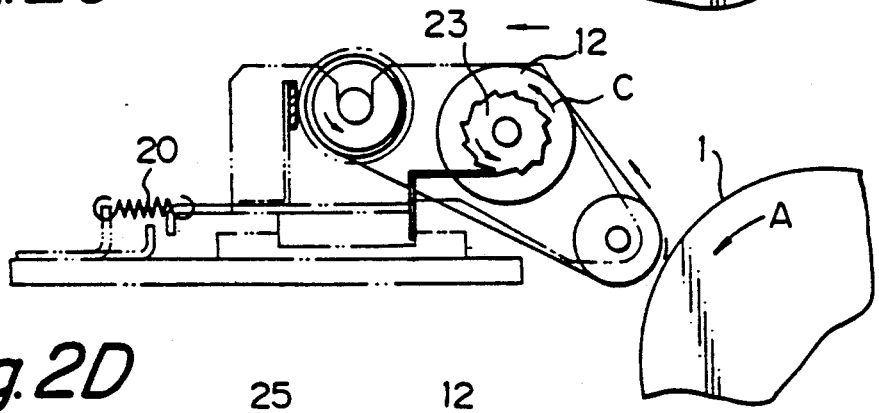
Figure 2D:
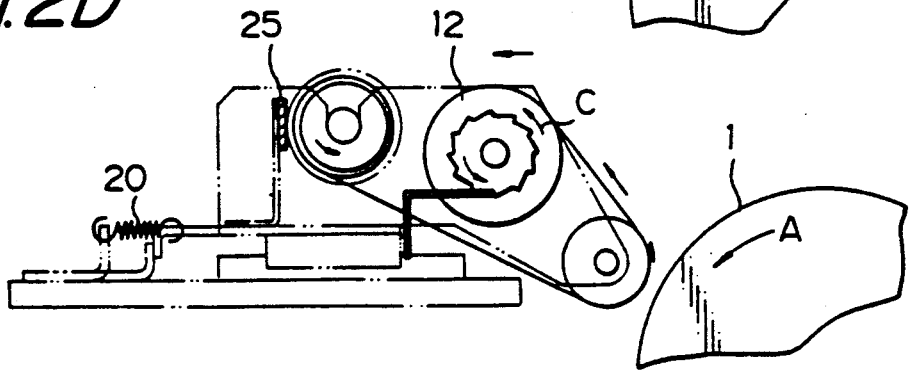

The arm 3, which is connected to the access solenoid 2, is then rotated clockwise in FIG. 1, around the pin 4, to move the retainer 13 from the position in FIG. 2*a* (stand-by position) to the position in FIG. 2B (operating position) whereby the lapping sheet 15 is pressed against the surface of the magnetic drum 1, as shown in FIG. 2*b*, by the pressure roller 16.

The pressure roller 16 is made of an elastic material, such as rubber, and therefore, the lapping sheet 15 is pressed against the surface of the drum 1 with a constant force which is determined by the stroke of the access solenoid 2 and the elastic modulus of the material of the pressure roller 16.

At this point the CPU 118 starts the vertical scanning operation by activating the vertical scanning motor 160 so that the carriage 17 is moved in parallel to the axis of the magnetic drum 1 (in the direction of an arrow B in FIG. 1) at a constant speed along the guides 18 and 19, thereby the surface of the magnetic drum 1 is polished by the lapping sheet 15.

When the vertical scanning of the carriage 17 is completed, i.e., the sensors 129 detect that the carriage 17 has reached a position at the end of the vertical scanning movement, the CPU 118 stops the vertical scanning motor 160, to hold the carriage 17 in that position, and deenergizes the access solenoid 2. When the access solenoid 2 is deenergized, the retainer 13 is pulled back to the stand-by position by the return spring 20, and thus the lapping sheet 15 and the pressure roller 16 are moved away from the surface of the drum 1.

In this embodiment, the take-up reel 12 of the lapping unit 10 is equipped with a ratchet wheel 12 on the axis thereof, and during the return motion of the retainer 13 to the stand-by position, a bar-like member 24, which is fixed to the base plate 14, is pressed against a ratchet of the ratchet wheel 12 and turns the take up reel 12 by a predetermined amount, whereby the take up reel 12 winds the lapping sheet 15 from the supply reel 11 to bring a fresh portion of the lapping sheet 15 onto the pressure roller 16. (refer to FIGS. 2*c* and 2*d*)

The take up reel 12 is able to rotates in only one direction (i.e., in the direction of an arrow C in FIGS. 2C, 2D) to prevent a slackening of the lapping sheet 15 during the lapping operation, and to this end, a brake plate 25 is attached to the retainer 13 and is pressed against the surface of the lapping sheet roll on the supply reel, to maintain the lapping sheet 15 at a constant tension.

After the portion of the lapping sheet 15 on the pressure roller 16 is renewed, the CPU 118 of the lapping control unit 100 energizes the access solenoid 2 again to press the renewed portion of the lapping sheet 15 against the surface of the magnetic drum, and starts the vertical scanning of the carriage 17 in the reverse direction, whereby a second lapping operation is carried out. After completion of the second lapping operation, the portion of the lapping sheet 15 on the pressure roller 16 is renewed, and a third lapping operation is carried out, as required, in the same manner as for the first lapping operation, and accordingly any required number of lapping operations can be carried out.

If an odd number of lapping operations is carried out, another vertical scanning is carried out, after all of those lapping operations are completed, in which the retainer 13 is held in the stand-by position (FIG. 2*d*) to return the carriage to the initial position without carrying out a further lapping operation.

Figures 4, 4A, 4B:
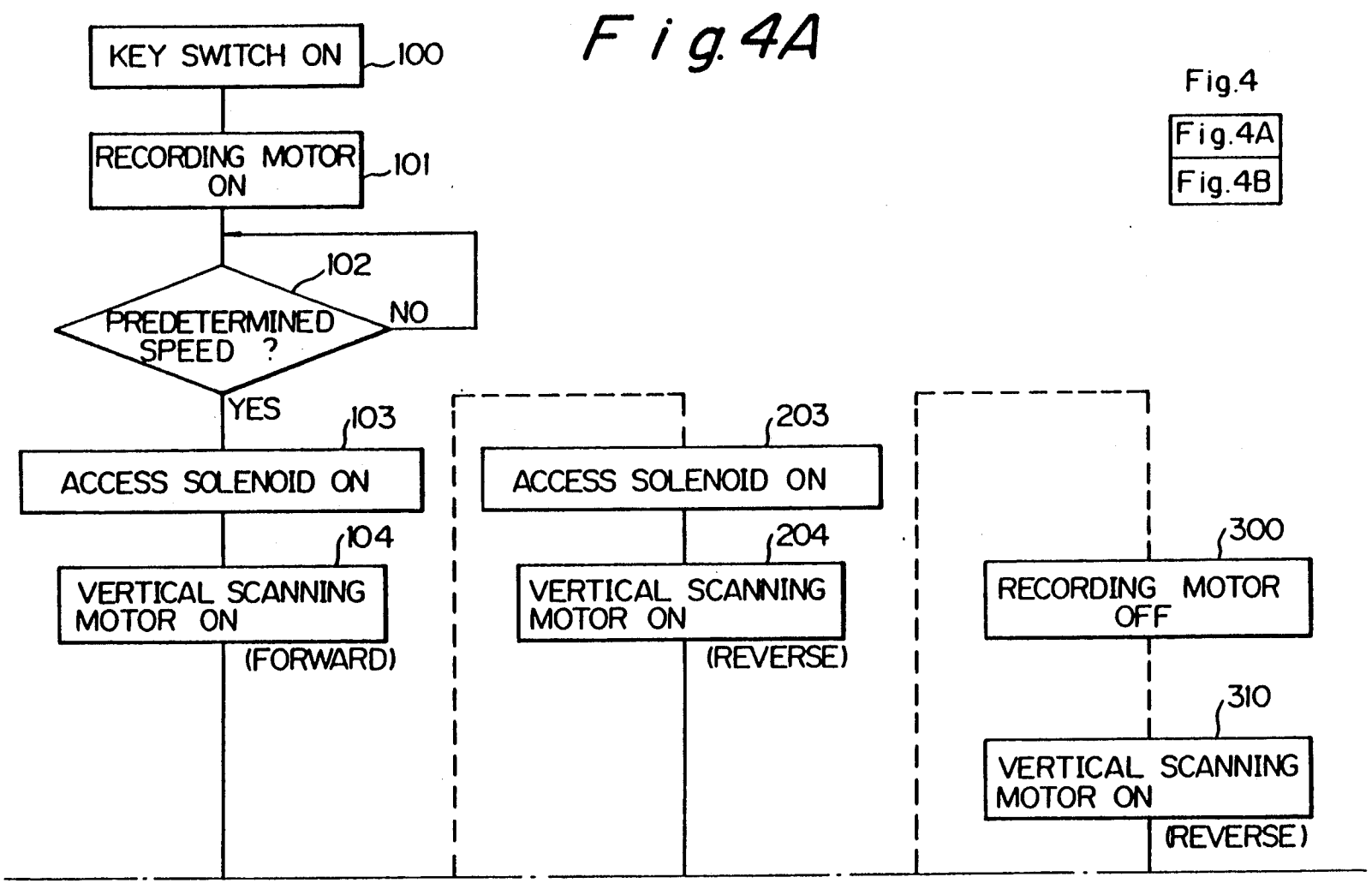
FIG. 4 is a flow chart of the operation of the lapping control unit during the lapping operation; and, FIG. 5 is a side elevational view of a head support unit mounted on the carriage of the magnetographic printing machine for a normal operation.
Figure 4B:
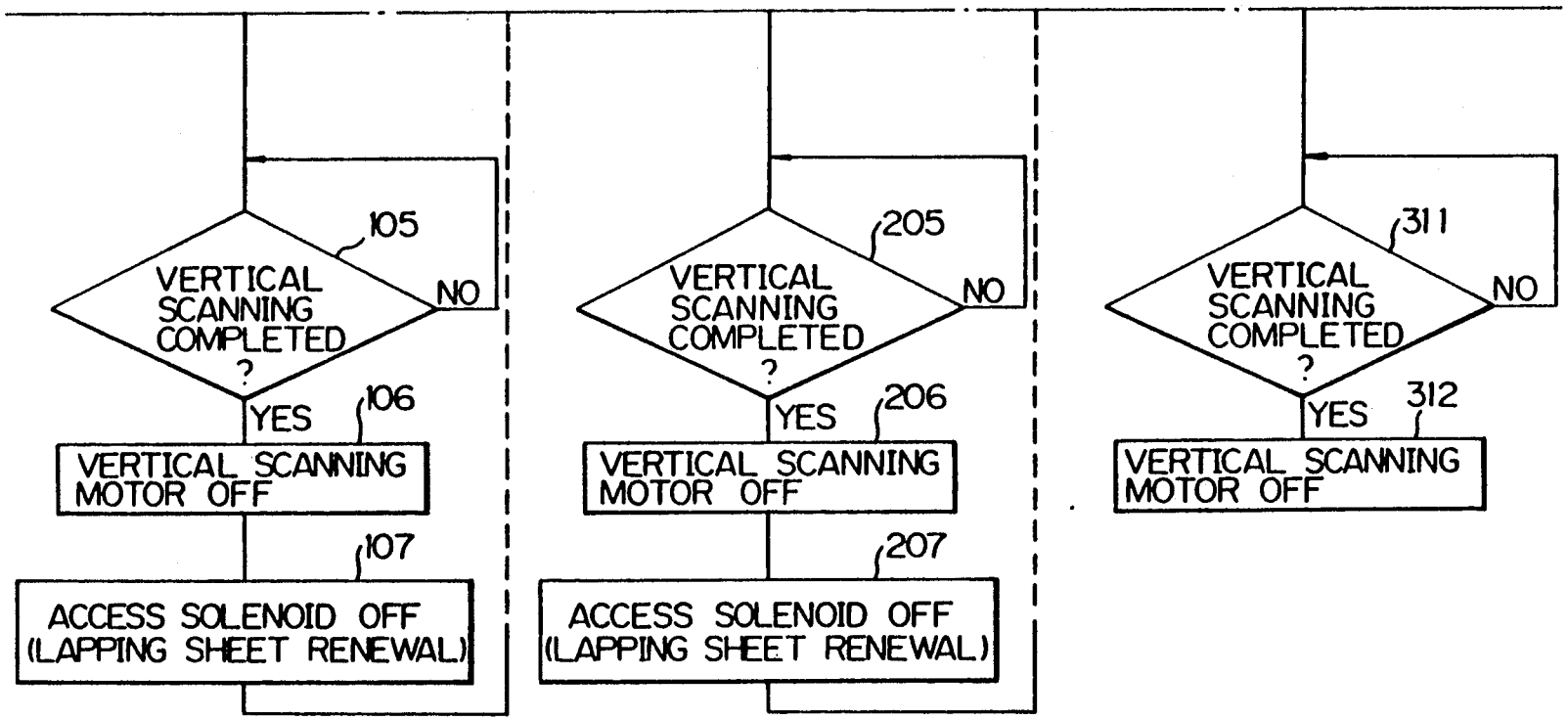

FIG. 4 is a flow diagram showing the control step carried out by the CPU 118 for the above-described lapping operations.

As shown in the Figure, When the key switch 126 is made ON (Step 100), the CPU 118 starts the recording motor 125 of the magnetic drum 1 (step 101), and then calculates the speed of rotation of the drum 1 and determines whether the speed has reached a predetermined value (step 102). When the speed of the drum has reached the predetermined value, the CPU 118 energizes the access solenoid 2 (step 103) and then starts the vertical scanning of the carriage 17 by activating the vertical scanning motor 160 (step 104). The CPU 118 then waits for the input of a signal from the sensors 129 indicating that the vertical scanning is completed (step 105), and upon receiving this signal from the sensors 129, the CPU 118 determines that the vertical scanning is completed and stops the vertical scanning motor 160 of the carriage 17 (step 106). The CPU 118 then deenergizes the access solenoid 2, to renew the lapping sheet 15 on the pressure roller 16 (step 107). The steps 103 to 107 are repeated at predetermined intervals (steps 203–207). After repeating the steps 103 to 107 a predetermined number of times, the CPU 118 stops the recording motor 125 of the magnetic drum 1, and thus completes the lapping operations (step 300).

If the vertical scanning is repeated by an odd number, the steps 204 to 206 are performed after the step 300, to return the carriage to the initial position. (steps 310 to 312).

The lapping operation in this embodiment, for removing foreign matter from the magnetic drum surface, is now explained. Usually, this kind of the lapping operation is carried out periodically during the normal operation of the magnetographic printing machine, but the automatic lapping device according to the present invention can be also used in the process of manufacturing the magnetographic printing machine on the production line of a factory. The magnetic drum of the magnetographic machine is usually produced by an electroplating process in which a magnetic material layer is formed on the drum surface, and the surface of this magnetic material layer formed by electro plating must be polished to a required smoothness. The lapping device according to the invention also can be used for this polishing process, at the final stage of the manufacturing process.

As explained above, according to the present invention, the lapping operation of the magnetic drum surface is carried out automatically, and thus ensures that the lapping sheet is pressed with a constant pressure against the drum surface, and thus a uniform lapping of the drum surface can be achieved by even a non-skilled person. Further, since it is not necessary to press the lapping sheet by hand against the drum while the drum is rotating at a high speed, the safety of the operation is increased.

The present invention is not restricted to the illustrated embodiment and can be modified without departing from the scope and spirit of this invention.

We claim:

1. An automatic lapping device for polishing a magnetic drum surface of a magnetographic printing machine with a lapping sheet, comprising:

a lapping unit including a retainer means for retaining the lapping sheet and movable between a stand-by position in which the lapping sheet is held away from the magnetic drum surface and an operating position in which said lapping sheet is pressed against the drum surface with a predetermined force, an access means for moving said retainer means between said stand-by position and said operating position, and a lapping sheet renewal means for shifting the lapping sheet to bring a fresh portion thereof into contact with the magnetic drum surface in response to the movement of said retainer means between said operating position and said stand-by position;

a vertical scanning means for moving said lapping unit in parallel to the axis of rotation of said magnetic drum;

a drive means for rotating said magnetic drum; and a lapping control means for controlling the operation of said access means, said vertical scanning means and said driving means in accordance with a predetermined procedure, to thereby polish the drum surface.

2. An automatic lapping device according to claim 1, wherein said lapping unit further comprises, a base plate on which said access means, said retainer means, and said lapping sheet renewal means are mounted.

3. An automatic lapping device according to claim 2, wherein said retainer means comprises, a supply reel holding a roll of the lapping sheet, a take up reel for winding the lapping sheet from said supply reel, a pressure roller for pressing the lapping sheet against the magnetic drum surface with a predetermined force when the retainer means is in the operating position, and a support member slidably mounted on said base plate of the lapping unit and supporting said supply reel, said take up reel and said pressure roller.

4. An automatic lapping device according to claim 3, wherein said access means comprises a solenoid actuator and a return spring, which are connected to said support member.

5. An automatic lapping device according to claim 3, wherein said lapping sheet renewal means comprises, a ratchet wheel connected to said take up reel and a member fixed on the base plate of the lapping unit, said member engaging a ratchet of said ratchet wheel when said retainer means moves from the operating position to the stand-by position and pushes against said ratchet to rotate said take up reel by a predetermined angle.

6. An automatic lapping device according to claim 1 wherein said lapping unit is mounted on a carriage of a magnetic recording head of the magnetographic printing machine, for polishing the drum surface, and said vertical scanning means and said driving means are constituted by a vertical scanning mechanism of the carriage and a recording motor of the magnetic drum, respectively, incorporated in the magnetographic printing machine.

7. An automatic lapping device according to claim 1, wherein said lapping control means is a control circuit permanently installed in the magnetographic printing machine.

* * * * *